1/31/84 XR 4,429,304

United States Patent [19]

Fujita

[11] 4,429,304

[45] Jan. 31, 1984

[54] DISPLAY DRIVING DEVICE

[75] Inventor: Masanori Fujita, Tokyo, Japan

[73] Assignee: Seikosha Co., Ltd., Tokyo, Japan

[21] Appl. No.: 256,045

[22] Filed: Apr. 21, 1981

Related U.S. Application Data

[63] Continuation of Ser. No. 72,333, Sep. 5, 1979, abandoned.

[30] Foreign Application Priority Data

Sep. 6, 1978 [JP] Japan ..... 53-110166

[51] Int. Cl.[3] ..... G09G 3/18

[52] U.S. Cl. ..... 340/765; 340/784; 340/805; 350/332

[58] Field of Search ..... 340/752, 784, 765

[56] References Cited

U.S. PATENT DOCUMENTS

| | | | |
|---|---|---|---|
| 3,835,463 | 9/1974 | Tsukamoto et al. | 340/784 |
| 3,848,247 | 11/1974 | Sherr | 340/752 |
| 3,973,252 | 8/1976 | Mitomo et al. | 340/784 |
| 3,975,085 | 8/1976 | Yamada et al. | 340/784 X |
| 4,110,967 | 9/1978 | Fujita | 368/30 X |
| 4,142,182 | 2/1979 | Kmetz | 340/765 |
| 4,300,137 | 11/1981 | Fujita et al. | 340/784 X |

*Primary Examiner*—David L. Trafton

*Attorney, Agent, or Firm*—Robert E. Burns; Emmanuel J. Lobato; Bruce L. Adams

[57] ABSTRACT

In a display device constructed by interposing an electrooptical substance between one group of electrodes and another group of electrodes, a pair of electrodes are time-divisionally and sequentially selected among one group of electrodes, and a train of low-voltage pulses are applied across the selected electrodes and predetermined electrodes of another group of electrodes, so that the operation margin of the driving voltage is increased and multiplicity of digits can be driven.

3 Claims, 27 Drawing Figures

FIG.7

| $T_0$ \ $T_8$ | $q_1$ | $q_2$ | $q_3$ | $q_4$ | $q_5$ | $q_6$ | $q_7$ |
|---|---|---|---|---|---|---|---|
| $c_1$ | $p_2$ | $p_4$ | $p_4$ | $p_4$ | $p_4$ | $p_4$ | $p_3$ |
| $c_2$ | $p_3$ | $p_2$ | $p_4$ | $p_4$ | $p_4$ | $p_4$ | $p_4$ |
| $c_3$ | $p_4$ | $p_3$ | $p_2$ | $p_4$ | $p_4$ | $p_4$ | $p_4$ |
| $c_4$ | $p_4$ | $p_4$ | $p_3$ | $p_2$ | $p_4$ | $p_4$ | $p_4$ |
| $c_5$ | $p_4$ | $p_4$ | $p_4$ | $p_3$ | $p_2$ | $p_4$ | $p_4$ |
| $c_6$ | $p_4$ | $p_4$ | $p_4$ | $p_4$ | $p_3$ | $p_2$ | $p_4$ |
| $c_7$ | $p_4$ | $p_4$ | $p_4$ | $p_4$ | $p_4$ | $p_3$ | $p_2$ |
| $x_1$ | 0 | 1 | 1 | 1 | 1 | 1 | 1 |
| $x_2$ | 1 | 0 | 0 | 1 | 0 | 0 | 0 |
| $x_3$ | 1 | 0 | 0 | 1 | 0 | 0 | 0 |
| $x_4$ | 1 | 0 | 0 | 1 | 0 | 0 | 0 |
| $x_5$ | 0 | 1 | 1 | 1 | 1 | 1 | 1 |
| $y_1$ | 1 | 1 | 1 | 1 | 1 | 1 | 0 |
| $y_2$ | 0 | 0 | 1 | 0 | 0 | 0 | 1 |
| $y_3$ | 0 | 0 | 1 | 0 | 0 | 0 | 1 |
| $y_4$ | 0 | 0 | 1 | 0 | 0 | 0 | 1 |
| $y_5$ | 1 | 1 | 1 | 1 | 1 | 1 | 0 |
| $s_1$ | $p_6$ | $p_7$ | $p_7$ | $p_7$ | $p_7$ | $p_7$ | $p_5$ |
| $s_2$ | $p_5$ | $p_8$ | $p_6$ | $p_5$ | $p_8$ | $p_8$ | $p_6$ |
| $s_3$ | $p_5$ | $p_8$ | $p_6$ | $p_5$ | $p_8$ | $p_8$ | $p_6$ |
| $s_4$ | $p_5$ | $p_8$ | $p_6$ | $p_5$ | $p_8$ | $p_8$ | $p_6$ |
| $s_5$ | $p_6$ | $p_7$ | $p_7$ | $p_7$ | $p_7$ | $p_7$ | $p_5$ |

FIG.9A

| R·E \ C·E | 2Vo | Vo |
|---|---|---|
| 0 | 2Vo | Vo |
| 2Vo | 0 | -Vo |

FIG.9B

| R·E \ C·E | 3Vo | Vo |
|---|---|---|
| 0 | 3Vo | Vo |
| 2Vo | Vo | -Vo |

FIG.10

| Va \ N | 2 | 3 | 4 | 5 | 6 | 7 |
|---|---|---|---|---|---|---|
| A | 2.236 | 1.732 | 1.528 | 1.414 | 1.342 | 1.291 |
| B | 2.236 | 1.915 | 1.732 | 1.612 | 1.528 | 1.464 |

FIG.12

| $T_0$ \ $T_t$ | $q_1$ | $q_2$ | $q_3$ |
|---|---|---|---|
| $c_1$ | $p_2$ | $p_4$ | $p_4$ |
| $c_2$ | $p_4$ | $p_2$ | $p_4$ |
| $c_3$ | $p_4$ | $p_4$ | $p_2$ |
| $c_4$ | $p_3$ | $p_4$ | $p_4$ |
| $c_5$ | $p_4$ | $p_3$ | $p_4$ |
| $c_6$ | $p_4$ | $p_4$ | $p_3$ |
| $x_1$ | 1 | 1 | 1 |
| $x_2$ | 1 | 0 | 0 |
| $x_3$ | 1 | 0 | 0 |
| $x_4$ | 1 | 0 | 0 |
| $x_5$ | 0 | 1 | 1 |
| $y_1$ | 1 | 1 | 1 |
| $y_2$ | 1 | 0 | 0 |
| $y_3$ | 1 | 0 | 0 |
| $y_4$ | 1 | 0 | 0 |
| $y_5$ | 0 | 0 | 0 |
| $s_1$ | $p_7$ | $p_7$ | $p_7$ |
| $s_2$ | $p_7$ | $p_8$ | $p_8$ |
| $s_3$ | $p_7$ | $p_8$ | $p_8$ |
| $s_4$ | $p_7$ | $p_8$ | $p_8$ |
| $s_5$ | $p_8$ | $p_5$ | $p_5$ |

DISPLAY DRIVING DEVICEsp

This is a continuation of application Ser. No. 072,333, filed Sept. 5, 1979, and now abandoned.

BACKGROUND OF THE INVENTION

Generally, display devices having large amounts of information to be displayed, such as digital electronic timepieces or desktop calculators with various functions, have been employing a liquid crystal display panel, and, in general, have further been employing a voltage-averaging time divisional driving method. Electronic watches in which it is required to satisfy conditions of low electric power and small size are employing a so-called V-2 V driving method by which a maximum voltage when the picture elements are not displayed is given by V and a maximum voltage when the picture elements are displayed is given by 2 V. This method features low power consumption, reduced number of parts for constructing a booster circuit and good boosting efficiency. However, when the number of digits to be time-divisionally scanned is increased, the operation margin which is a ratio of an effective voltage when the picture elements are not displayed to an effective voltage when the picture elements are displayed, is drastically decreased, causing the display to be obscured due to the development of crosstalk. Such a defect can be precluded by the employment of a so-called V-3 V method by which a maximum voltage when the picture elements are displayed is given by 3 V. This method, however, consumes increased amounts of electric power and requires an increased number of battery cells, making it difficult to construct the display devices in small sizes.

SUMMARY OF THE INVENTION

The present invention is related to a display driving device for driving a display, and specifically to a device which sequentially selects at least a pair of electrodes among a group of electrodes constituting a display device.

The object of the present invention therefore is to provide a device which sequentially selects at least a pair of electrodes from a group of electrodes which constitute a display together with another group of electrodes, and which applies low-voltage pulses across the selected electrodes and predetermined electrodes of another group of electrodes, in order to increase the operation margin as well as to enhance the performance of multi-digit driving and response when a liquid crystal or the like is employed.

Another object of the present invention is to provide a device which employes low-voltage pulses, and which can be used for timepieces contributing to the reduction in timepiece sizes.

BRIEF DESCRIPTION OF THE DRAWINGS

The nature of the present invention as well as other objects and advantages thereof will become more apparent from the consideration of the following detailed description and the accompanying drawings in which:

FIG. 7 is a diagram for illustrating an operating condition of FIG. 1;

FIGS. 9A and 9B show the states in which voltages are applied according to a conventional art;

FIG. 10 is a diagram showing the states in which voltages are applied according to the abovementioned embodiment in comparison with the conventional art;

FIG. 12 is a diagram for illustrating an operation of FIG. 11;

DESCRIPTION OF THE PREFERRED EMBODIMENTS

An embodiment of the present invention is described in detail in conjunction with the drawings.

Figure 1:
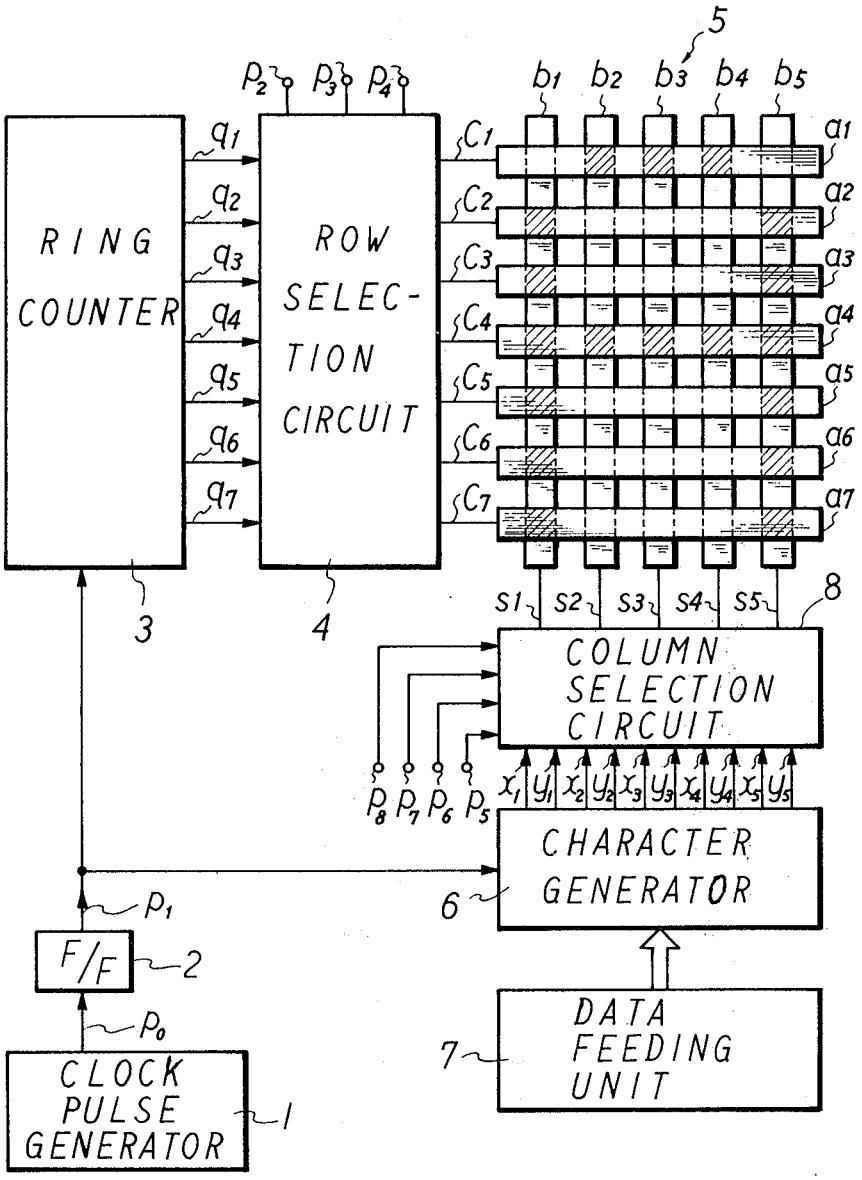
FIG. 1 shows a block diagram of electric circuits and is a plan view showing electrodes arrayed according to an embodiment of the present invention.

Referring to FIG. 1, a clock pulse generator 1 produces clock pulses at a terminal $p_0$. The frequency of the clock pulses is reduced to one-half by a flip-flop circuit 2. A ring counter 3 successively produces timing pulses at output terminals $q_1$ to $q_7$ upon receipt of pulses from a terminal $p_1$. These timing pulses successively select pairs of output terminals $c_1$–$c_2$, $c_2$–$c_3$, $c_3$–$c_4$, $c_4$–$c_5$, $c_5$–$c_6$, $c_6$–$c_7$ and $c_7$–$c_1$ of a row selection circuit 4, so that potentials applied to terminals $p_2$ and $p_3$ are generated at each pair of the output terminals and a potential applied to a terminal $p_4$ is generated at the non-selected output terminals. A matrix electrode 5 illustratively shows only the array of electrodes of a conventional matrix display, wherein the crossing portions constitute picture elements that serve as display elements.

A character generator 6 receives information to be displayed, from a data feeding unit 7, and produces a bit pattern corresponding to a character or the like that is to be displayed on the matrix display device upon receipt of an output pulse from the clock pulse generator 1. Display data for picture elements defined by the electrodes located on an upper portion in the drawing among the matrix electrodes selected by the pairs of outputs, are generated on the output terminals $x_1$ to $x_5$, and display data for picture elements located on a lower portion are generated on the output terminals $y_1$ to $y_5$. However, when the lowermost and uppermost electrodes are selected, the upper and lower relations are reversed. A column selection circuit 8 selects predetermined potentials among those applied to four terminals $p_5$ to $p_8$ utilizing the output of the character generator 6.

Figure 2:
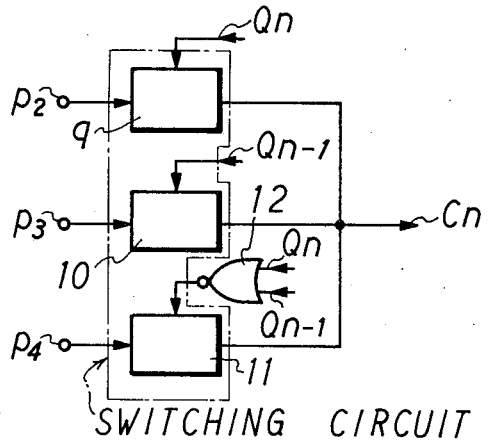
FIGS. 2 and 3 are block diagrams showing in detail major portions of FIG. 1.

FIG. 2 shows a row selection circuit 4 consisting of switching elements 9 to 11 such as bilateral switches and a gate circuit 12, in which n represents an integer of 1 to 7, Qn represents an output from an output terminal $q_n$ of the ring counter 3, and $Q_0$ an output from an ouput terminal $q_7$. The switching elements 9 to 11 permit pulses applied to terminals $p_2$, $p_3$, $p_4$ to pass through when the inputs $Q_n$, $Q_{n-1}$ and the output of the gate circuit 12 are logic "1" (herein after referred to as "1").

Figure 3:
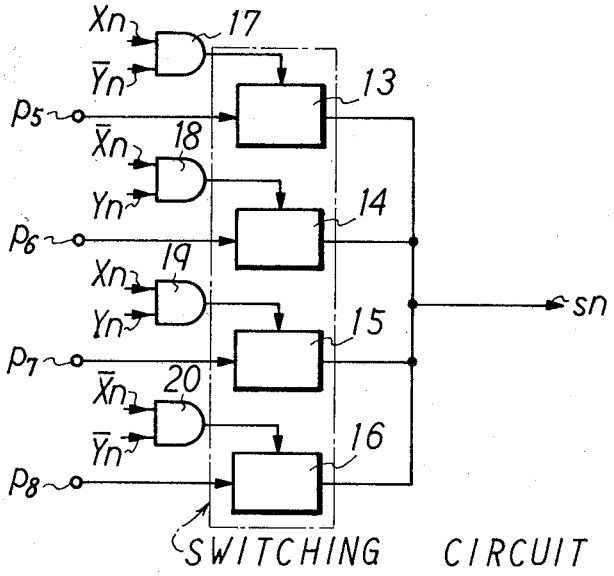
Figure 4A:
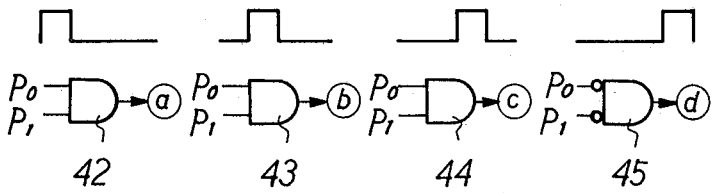
FIGS. 4A–4H are views showing circuits for forming pulses for use in the abovementioned embodiment.
Figure 4B:
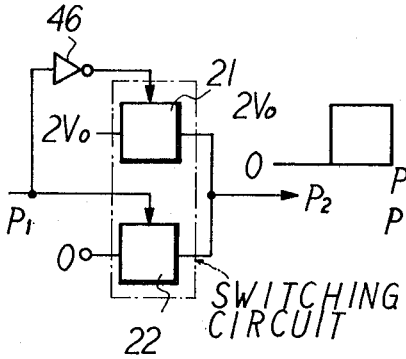
Figure 4C:
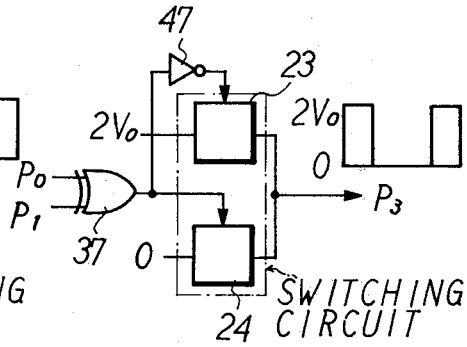
Figure 4D:
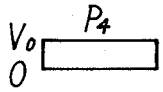
Figure 4E:
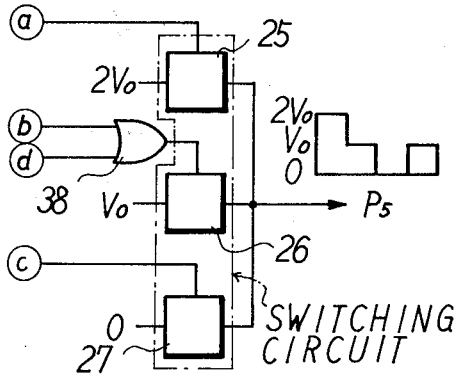
Figure 4F:
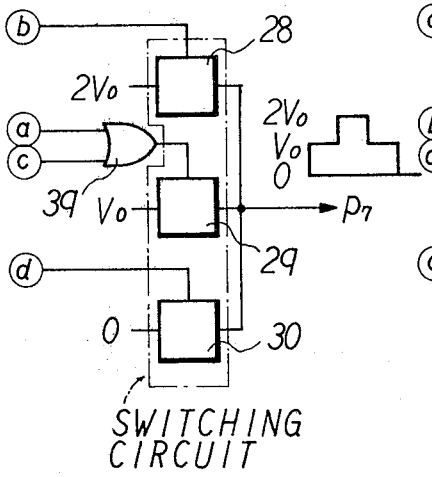
Figure 4G:
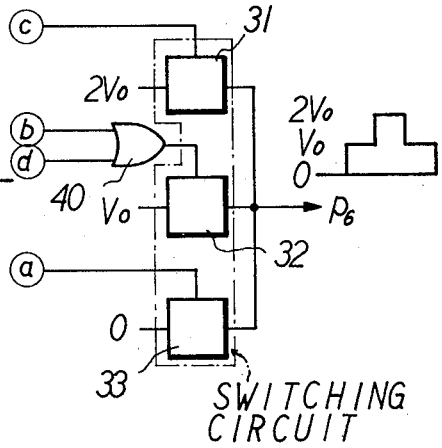
Figure 4H:
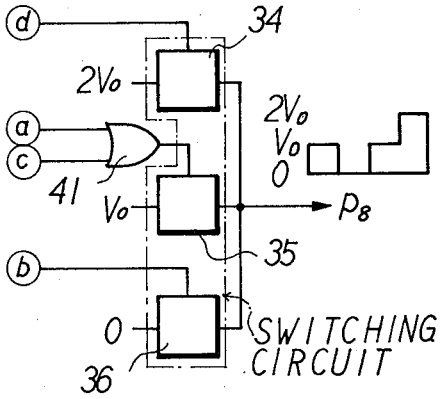

FIG. 3 shows a column selection circuit 8 consisting of switching elements 13 to 16 such as bilateral switches and gate circuits 17 to 20. Symbols $X_n$, $Y_n$ denote outputs of output terminals $x_n$, $y_n$ of the character generator 6, and an output $\overline{X}n$ represents an inversed logical value of the output Xn. The switching elements 13 to 16 function in the same manner as shown in FIG. 2. FIGS. 4A–4H show circuits for forming a variety of pulses used for the embodiment of the present invention, consisting of switching elements 21 to 36, gate circuits 37 to 45, and inverters 46 and 47.

Figure 5:
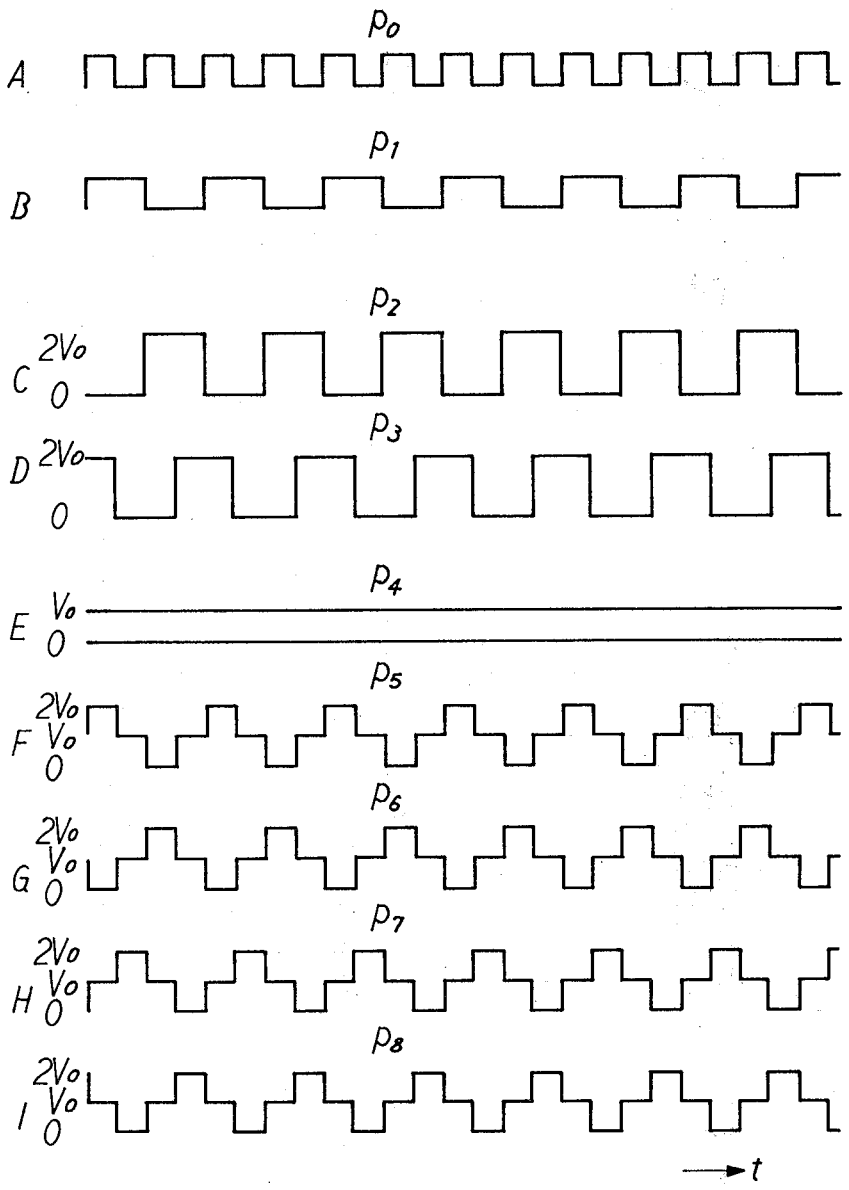
FIGS. 5 and 6 are diagrams of pulse waveforms for illustrating the operation of FIG. 1.

The circuit operation when the hatched picture elements of the matrix electrode 5 of FIG. 1 are to be displayed is described below. Pulses Po shown in the diagram A of FIG. 5 are generated at the output terminal po of the clock pulse generator 1, and pulses $p_1$ shown in the diagram B of FIG. 5 are generated at the flip-flop terminal $p_1$. Timing pulses are successively generated at the output terminals $q_1$ to $q_7$ of the ring counter 3 in synchronism with the pulses $P_1$. As the pulses are generated at the output terminal $q_1$, pulses $P_2$ shown in the diagram C of FIG. 5 and pulses $P_3$ shown in the diagram D of FIG. 5 are generated at the output terminals $c_1$ and $c_2$. They correspond to the outputs generated at the terminals $c_1$ and $c_2$ when n is set to be 1 and 2 in FIG. 2. The output $P_4$ shown in the diagram E of FIG. 5 is generated at the other terminals $c_3$ to $c_7$. On the other hand, data bits (0 1 1 1 0) for displaying the picture elements in a row electrode $a_1$ are produced at the output terminals ($x_1$ $x_2$ $x_3$ $x_4$ $x_5$) of the character generator 6, and data bits (1 0 0 0 1) corresponding to a row electrode $a_2$ are produced at the output terminals ($y_1$ $y_2$ $y_3$ $y_4$ $y_5$). Based upon the data bits, the column selection circuit of FIG. 3 selects predetermined pulses $P_5$ to $P_8$ shown in the diagrams F to I of FIG. 5. Here, it should be understood that pulses denoted by a capital letter Pn are fed to a corresponding terminal denoted by a small letter $p_n$.

Figure 6:
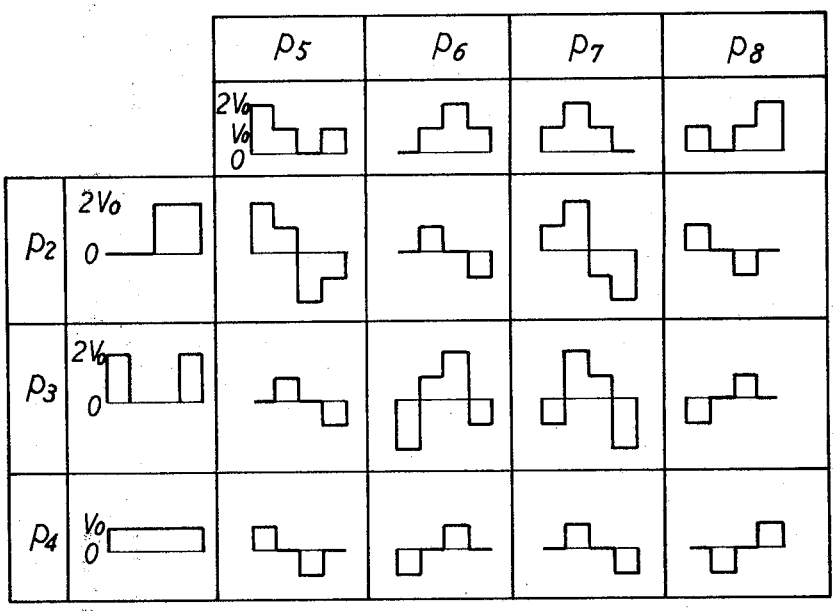

When n=1, pulses are generated on an output terminal $s_1$ of the column selection circuit 8. When the logical value at the output terminal $x_1$ is "0" and the logical value at the output terminal $y_1$ is "1", the logical value produced by the gate circuit 18 comes to "1", whereby the switching element 14 is closed. Therefore, pulses $P_6$ of the diagram G of FIG. 5 are generated at the output terminal $s_1$. Likewise, pulses $P_5$ of the diagram F of FIG. 5 are produced on the output terminals $s_2$ to $s_4$, and pulses $P_6$ are produced on the output terminal $s_5$. Accordingly, output correspoding to the differences between the output pulses $P_2$, $P_3$ of the output terminals $s_1$ to $s_5$, are applied to the picture elements of the row electrodes $a_1$ and $a_2$. FIG. 6 shows output waveforms corresponding to the abovementioned differences, from which it will be obvious that the picture elements are displayed only when the pulses $P_5$, $P_2$ and pulses $P_6$, $P_3$ are applied. Namely, the hatched portions of FIG. 1 are displayed. Further, pulses $P_4$ shown in the diagram E of FIG. 5 have been produced on the output terminals $c_3$ to $c_7$ of the row selection circuit 4, and a voltage corresponding to the difference between the output pulse $P_5$ and the output pulse $P_6$ of the output terminals $s_1$ to $s_5$ of the column selection circuit 8 has been applied to each of the picture elements. As shown in FIG. 6, however, this voltage does not cause the picture elements to display; no display occurs.

Then, when pulses are produced on the output terminal $q_2$ of the ring counter 3, pulses $P_2$ are produced on the output terminal $c_2$ of the row selection circuit 4 and pulses $P_3$ are produced on the output terminal $c_3$, and pulses $P_4$ are produced on the other output terminals $c_1$, $c_4$ to $c_7$. On the other hand, data bits (1 0 0 0 1) that are to be displayed by the picture elements of the row electrode $a_2$ are produced on the output terminals ($x_1$ $x_2$ $x_3$ $x_4$ $x_5$) of the character generator 6, and data bits (1 0 0 0 1) to be displayed by the picture elements of a row electrode $a_3$ are produced on the output terminals ($y_1$ $y_2$ $y_3$ $y_4$ $y_5$). Therefore, as will be obvious from FIG. 3, pulses ($P_7$ $P_8$ $P_8$ $P_8$ $P_7$) are produced on the output terminals $s_1$, $s_2$, $s_3$, $s_4$, $s_5$. Hence, a voltage corresponding to the difference between the output pulses of the output terminals $c_1$ to $c_7$ and the output pulses of the output terminals $s_1$ to $s_5$, is applied to the picture elements. As will be obvious from the voltage waveforms of FIG. 6, only the picture elements of row electrodes $a_2$, $a_3$ correspoding to the output terminals $s_1$, $s_5$ are displayed.

In effect, the hatched picture elements of row electrodes $a_2$, $a_3$ of FIG. 1 are displayed.

Likewise, the picture elements are displayed or non-displayed due to the voltage corresponding to the difference between the pair of outputs selected by the row selection circuit 4 and the output pulses produced on the output terminals $s_1$ to $s_5$ of the column selection circuit 8.

FIG. 7 is a list showing, in the lateral direction, terminals $t_q$ of the ring counter 3, and, in the vertical direction, the terminals $T_0$, i.e., output pulses produced on the output terminals $c_1$ to $c_7$ of the row selection circuit 4, data bits produced on the output terminals $x_1$ to $x_5$ and $y_1$ to $y_5$ of the character generator 6, and output pulses produced on the output terminals $s_1$ to $s_5$ of the column selection circuit 8.

Figure 8:
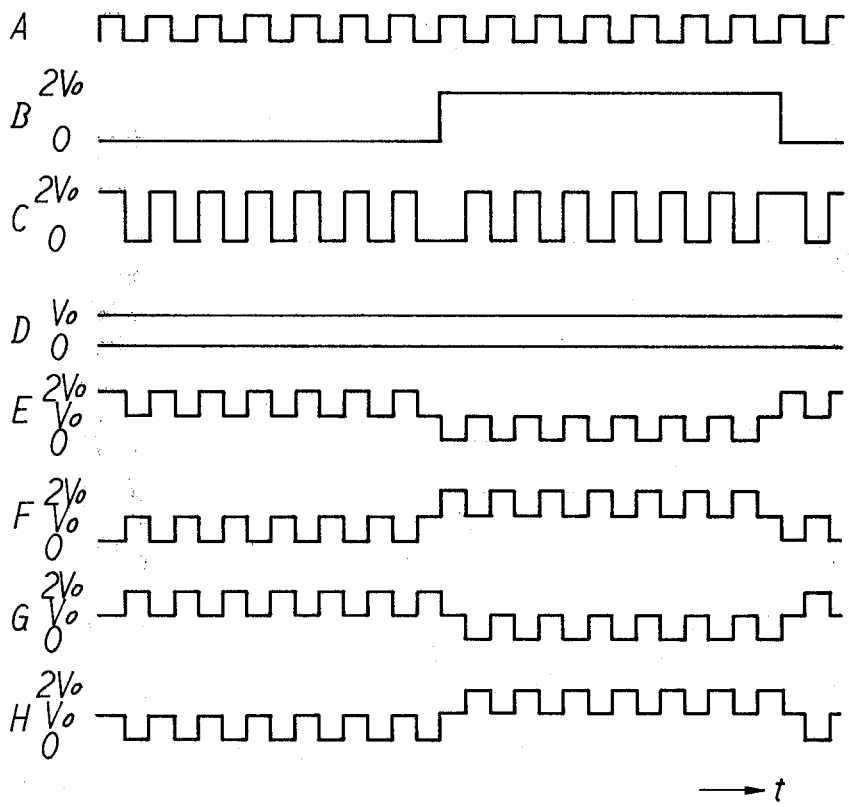
FIG. 8 shows pulse waveforms of major portions of FIG. 1.

The pulse waveforms used for the embodiment of the present invention need not necessarily be limited to the abovementioned examples only, but pulse waveforms which are reversed for each of the frames as shown in the diagrams B to H of FIG. 8 may be employed in place of the waveforms of the diagrams C to I of FIG. 5. In this case, the frequency of pulses shown FIG. 8A becomes smaller than that of the pulses Po of FIG. 5, such that the consumption of electric power is reduced.

Below is mentioned the operation margin according to the present invention in comparison with the conventional V–2 V and V–3 V methods. Let it be supposed that the display to which is applied the voltage is a display comprised of the matrix electrode shown in FIG. 1, and let a given row electrode among them and N units of column electrodes be considered.

According to the conventional V–2 V method, voltages 0, 2 Vo are selectively applied to the row electrodes RE, and voltages 2 Vo, Vo are selectively applied to the column electrodes CE as shown in the diagram A of FIG. 9. Therefore, in dynamically selecting the column electrodes, if the number of the column electrodes is N, a voltage 2 Vo is applied in the first scanning and a voltage Vo is applied in the (N−1)th scanning among N times of scanning. Hence, the operation margin α is given by, $$\alpha = \sqrt{\frac{(2Vo)^2 + Vo^2(N-1)}{Vo^2(N-1)}} = \sqrt{\frac{N+3}{N-1}} \quad (1)$$

According to the conventional V-3 V method, the voltages are applied as shown in the diagram B of FIG. 9. Therefore, similarly to the abovementioned method, the operation margin is given by, $$\alpha = \sqrt{\frac{(3Vo)^2 + (N-1)\,Vo^2}{Vo^2 N}} = \sqrt{\frac{8+N}{N}} \quad (2)$$

According to the present invention, on the other hand, display voltages shown in FIG. 6 are applied twice among the N times of scanning; i.e., step voltages 2 Vo and Vo are applied. Therefore, the operation margin $\alpha$ is given by, $$\alpha = \sqrt{\frac{(2Vo)^2 + Vo^2 \times 2 + (N-2)Vo^2}{NVo^2}} = \sqrt{\frac{8+N}{N}} \quad (3)$$

As mentioned above, the operation margin of the present invention becomes equal to that of the V-3 V method. From the comparison of the present invention B with the conventional V-2 V method A diagramatized in FIG. 10, it will be obvious that the present invention gives an increased operation margin.

Figure 11:
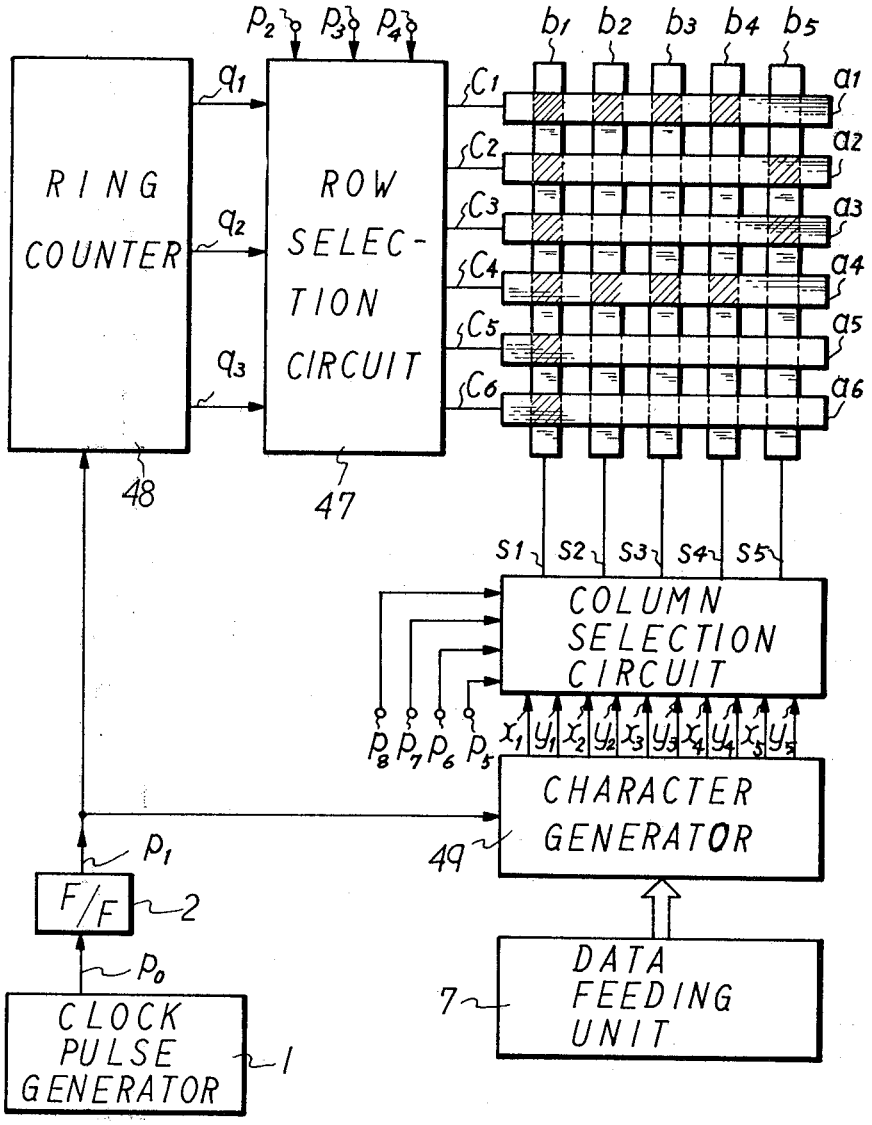
FIG. 11 shows a block diagram of electric circuits and is a plan view showing electrodes arrayed according to another embodiment of the present invention.

Below is mentioned an embodiment employing an even number of row electrodes. Referring to FIG. 11, a row selection circuit 47 sequentially generates output pulses on the pairs of output terminals $c_1$ and $c_4$, $c_2$ and $c_5$, and $c_3$ and $c_6$ responsive to the output pulses from the output terminals $q_1$ to $q_3$ of a ring counter 48. That is, when a pulse is produced on the output terminal $q_1$, a pulse $P_2$ shown in FIG. 5 is produced on the output terminal $c_1$, and a pulse $P_3$ is produced on the output terminal $c_4$. When a pulse is produced on the output terminal $q_2$, the pulse $P_2$ is produced on the output terminal $c_2$ and the pulse $P_3$ is produced on the output terminal $c_5$. When a pulse is produced on the output terminal $q_3$, the pulse $P_2$ is produced on the output terminal $c_3$ and the pulse $P_3$ is produced on the output terminal $c_6$. A pulse $P_4$ is produced on the output terminals of the row selection circuit 47 which is not generating the abovementioned pulses $P_2$ and $P_3$. The data bits produced on the output terminals $x_1$ to $x_5$ of the character generator 49 constitute information corresponding to the data of picture elements of row electrodes $a_1$, $a_2$ and $a_3$, generated in synchronism with the production of pulses on the output terminals $q_1$ to $q_3$. On the other hand, the data bits produced on the output terminals $y_1$ to $y_5$ correspond to the data of picture elements of row electrodes $a_4$ to $a_6$, which are generated in synchronism with the pulses produced on the output terminals $q_1$ to $q_3$. The same numerals as those of FIG. 1 represent the same functional elements.

FIG. 12 shows the state in which pulses are applied to display the hatched picture elements of FIG. 11.

Figure 13A:
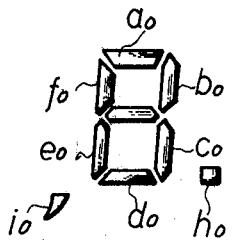
FIGS. 13A–13C is a plan view showing the electrodes arrayed according to a further embodiment of the present invention.
Figure 13B:
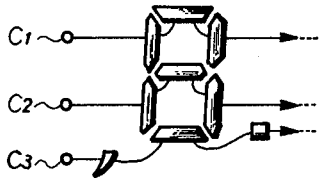
Figure 13C:
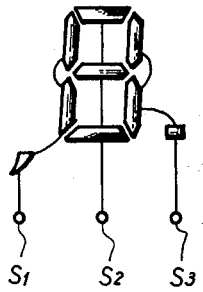

Below is mentioned another embodiment. FIG. 13A shows a display pattern consisting of a seven-segment numerical figure, comma and dot. Referring to FIGS. 13B and 13C, the electrodes constituting the pattern are separated into common electrodes and selection electrodes. The electrodes coupled by a line represent that they are electrically connected.

Figure 14:
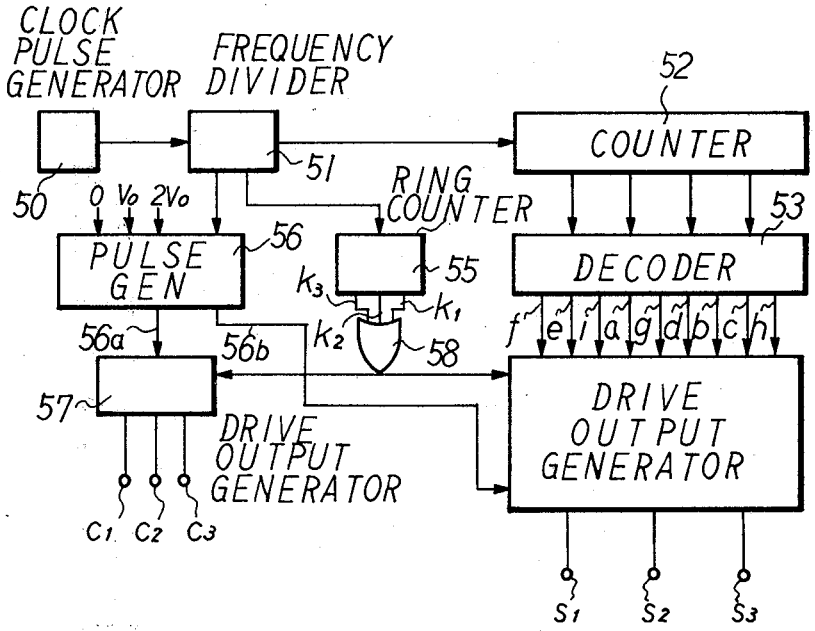
FIG. 14 is a block diagram of electric circuits therefor.

FIG. 14 shows a circuit for driving the abovementioned display pattern, in which reference numeral 50 denotes a clock pulse generator, 51 a frequency divider, 52 a counter, 53 a decoder, 54 a drive output generator for driving the selected electrodes, and reference numeral 55 denotes a divide-by-three ring counter. Reference numeral 56 designated a pulse generator circuit. Pulses shown in FIGS. 5C-5E are produced on an output terminal 56*a*, and pulses shown in the diagrams F, G, H and I of FIG. 5 are produced on an output terminal 56*b*. Reference numeral 57 designated a drive output generator for driving common electrodes, and reference numeral 58 represents a gate circuit.

Figure 15:
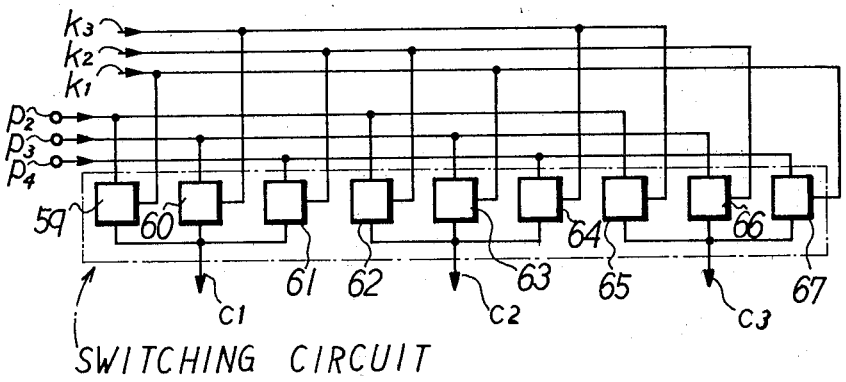
FIG. 15 and FIGS. 16A and 16B are block diagrams of major electric circuits of FIG. 14.

FIG. 15 and diagrams A and B of FIG. 16 are diagrams showing in detail the drive output generators 57 and 54. As an example, "2." is displayed on the display pattern of FIG. 13A.

The operation is now described. When the abovementioned pattern is to be displayed, logical values at the output terminals (f e i a g d b c h) (the outputs produced on these terminals are fed to display patterns ($f_o$ $e_o$ $i_o$ $a_o$ $g_o$ $d_o$ $b_o$ $c_o$ $h_o$) of the decoder 53 are (0 1 0 1 1 1 1 0 1). Therefore, when a first timing pulse is produced from a terminal $k_1$ of the ring counter 55, the pulse $P_2$ is produced on the output terminal $c_1$ via a switching element 59 of FIG. 15, the pulse $P_3$ is produced on the output terminal $c_2$ via a switching element 63, and the pulse $P_4$ is produced on the output terminal $c_3$ via a switching element 67.

Figure 16A:
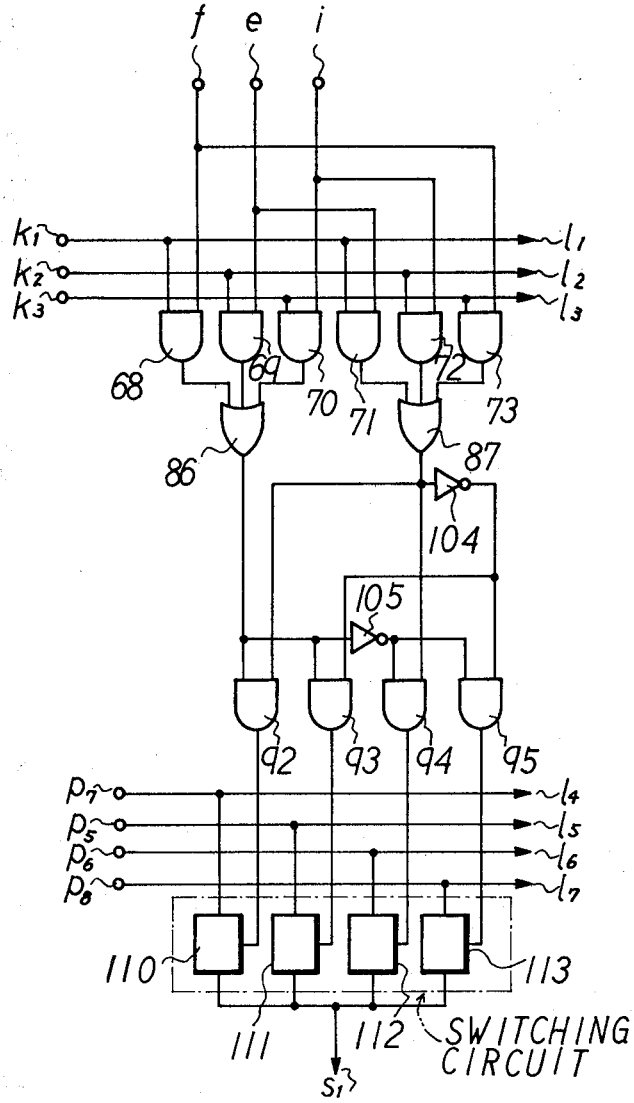
Figure 16B:
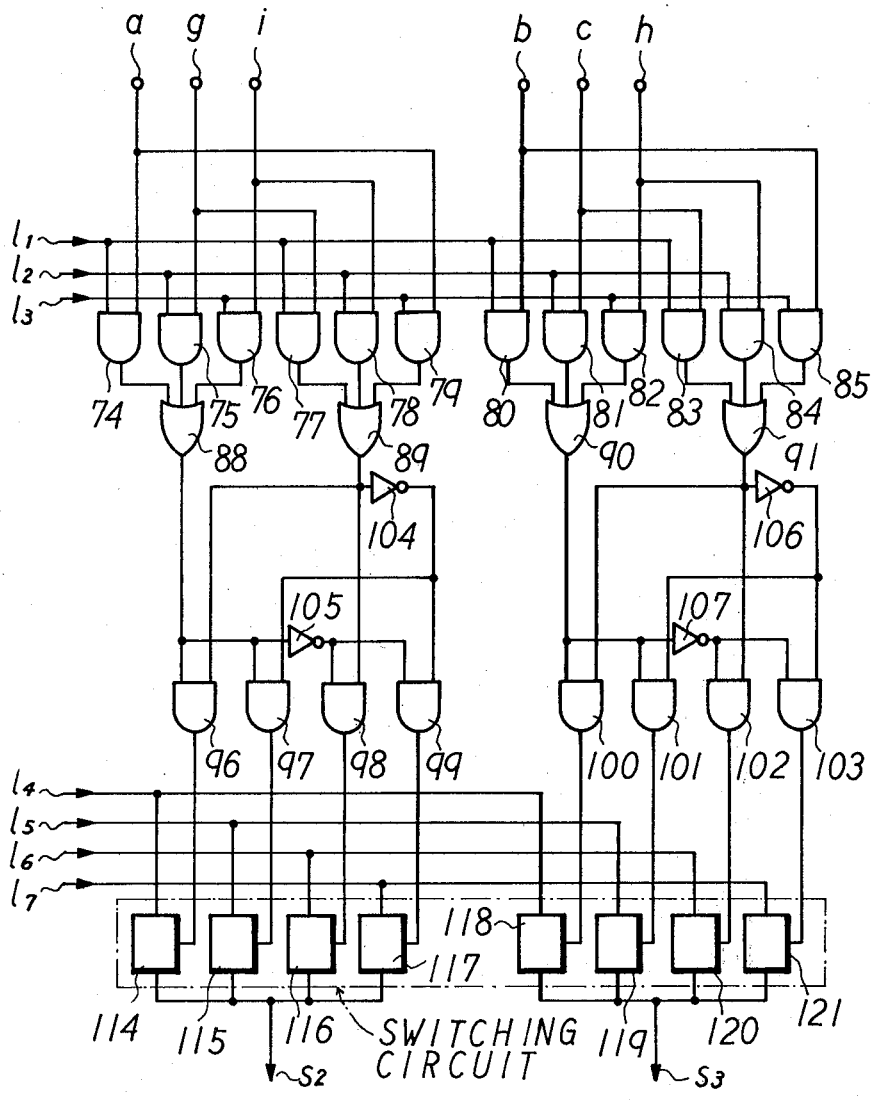

On the other hand, gate circuits 68, 71, 74, 77, 80 and 83 of FIGS. 16A and 16B are opened by the abovementioned first timing pulse produced on the terminal $c_1$ of the ring counter 55. Here, since the input terminals (e a g i b h) have "1", the gate circuits 71, 74, 77 and 80 produce "1". Therefore, the logical values produced by the gate circuits 94, 96 and 101 are all "1", whereby the switching elements 112, 114 and 119 are closed to permit the passage of pulses $P_6$, $P_7$ and $P_8$. Hence, pulses $P_6$, $P_7$ and $P_8$ are produced on the output terminals $s_1$, $s_2$ and $s_3$, respectively. Here, the pulses fed to the terminals of the abovementioned common electrodes $c_1$, $c_2$, $c_3$ are those denoted by $P_2$, $P_3$ and $P_4$. Consequently, as will be obvious from FIG. 6, the voltages applied to the terminals $c_1$-$s_2$, $c_1$-$s_3$, $c_2$-$s_2$ and $c_2$-$s_1$ cause the picture elements $a_o$, $b_o$, $g_o$, $e_o$ of the diagram A of FIG. 13 to be displayed.

Next, when a timing pulse is obtained from a terminal $k_2$ of the ring counter 55, the switching elements 61, 62 and 66 of FIG. 15 are closed, and pulses $P_4$, $P_2$ and $P_3$ are generated on the terminals $c_1$, $c_2$, and $c_3$, respectively. Referring to FIG. 16, on the other hand, the timing pulse produced on the terminal $k_2$ causes the gate circuits 69, 72, 75, 78, 81 and 84 to open, whereby "1" is produced on the terminals of the gate circuits 93, 96 and 102. Accordingly, pulses $P_5$, $P_7$ and $P_6$ are produced on the output terminals $s_1$, $s_2$ and $s_3$. Consequently, as will be obvious from FIG. 6, picture elements $g_o$, $e_o$, $d_o$, $h_o$ are displayed.

As a timing pulse is produced from a terminal $k_3$ of the ring counter 55, the switching elements 60, 64 and 65 of FIG. 15 are closed, and output pulses $P_3$, $P_4$ and $P_2$ are produced on the output terminals $c_1$, $c_2$ and $c_3$. Referring to FIG. 16, on the other hand, the gate circuits 70, 73, 76, 79, 82 and 85 are opened, whereby the outputs of the gate circuits 95, 96 and 100 become "1". Hence, the switching elements 113, 114 and 118 are closed to produce pulses $P_8$, $P_7$, $P_7$ on the output terminals $s_1$, $s_2$ and $s_3$. Referring to FIG. 6, therefore, the picture elements $a_o$, $b_o$, $d_o$ and $h_o$ are displayed.

Thus, "2." is displayed by means of timing pulses which are successively produced on the terminals $k_1$, $k_2$ and $k_3$ of the ring counter 55.

According to the present invention as mentioned in detail in the foregoing, at least a pair of electrodes among the electrodes constituting the display device are selected in a time-divisional manner. Fur- sequentially selection voltages applied to the electrodes, a maximum absolute voltage when the display device is displayed is given by 2 Vo, and a maximum absolute voltage when the display device is not displayed is given by Vo. Therefore, an increased operation margin can be obtained, and the multiplicity of digits can be driven over a wide range of temperature. Moreover, since the signals are applied to the picture elements for increased periods of time per cycle of scanning time, the response can be quickened. Besides, a small setpoint voltage enables the booster circuit to be simply constructed, lending the device itself well suited for timepieces which are constructed in compact sizes.

What is claimed is:

1. A display and driving circuit, comprising:

a plurality of first electrodes disposed in a regular array adjacent one another;

a plurality of second electrodes disposed in a regular array adjacent one another, said plurality of second electrodes disposed over said plurality of first electrodes with the second electrodes crossing the first electrodes;

an electroptical medium disposed between said plurality of first electrodes and said plurality of second electrodes and having optical properties responsive to electrical potentials, wherein a region of said electroptical medium where a first electrode and a second electrode cross defines a picture element for displaying visual information according to electrical signals applied to the crossing first and second electrodes, and said plurality of first electrodes and said plurality of second electrodes crossing said plurality of first electrodes defining an array of picture elements;

selection circuit means for selecting successive groups of first electrodes comprising at least a pair of first electrodes and for simultaneously applying different respective voltage signals to the first electrodes comprising the successively selected groups of first electrodes;

signal supply means responsive to control signals for simultaneously applying respective selected electrical signals to said second electrodes under control of said control signals for energizing selected picture elements defined by the selected group of said first electrodes and said second electrodes according to the selected electrical signals applied to said second electrodes; and data signal generating means for generating data signals in parallel bit format, equal in number to the number of first electrodes comprising the successively selected groups of first electrodes and corresponding to a pattern to be visually displayed and for applying the bits of successive ones of said data signals to said signal supply means as successive control signals for enabling picture elements defined by said selected group of first electrodes and said second electrodes to visually display the pattern represented by said data signals.

2. A display and driving circuit, comprising:

a plurality of first electrodes disposed in a regular array adjacent one another;

a plurality of second electrodes disposed in a regular array adjacent one another said plurality of second electrodes disposed over said plurality of first electrodes with the second electrodes crossing the first electrodes;

an electrooptical medium disposed between said plurality of first electrodes and said plurality of second electrodes and having optical properties responsive to electrical potentials, wherein a region of said electrooptical medium where a first electrode and a second electrode cross defines a picture element for displaying visual information according to electrical signals applied to the crossing first and second electrodes, and said plurality of first electrodes and said plurality of second electrodes crossing said plurality of first electrodes defining an array of picture elements;

selection circuit means for selecting successive groups of first electrodes comprising at least a pair of first electrodes and for simultaneously applying respective first and second voltage selection signals to the selected first electrodes and for applying a different third voltage selection signal to the non-selected first electrodes;

means responsive to control signals for simultaneously applying respective ones of four voltage signals to said second electrodes under control of said control signals for energizing selected picture elements defined by the selected group of said first electrodes and said second electrodes according to the selected electrical signals applied to said second electrodes, wherein the four voltage signals and the selection signals have the following relationships, when the third voltage selection signal and an arbitrary one of the four voltage signals are applied to the first and second electrodes of an arbitrary picture element it is turned off, when a first selection voltage signal and either the second or fourth voltage signals or when a second selection voltage signal and either the first or fourth voltage signals are applied to the first and second electrodes of an arbitrary picture element it is turned off, and when the first voltage selection signal and either the first and third voltage signals or when the second voltage selection signal and either of the second and third voltage signals are applied to the first and second electrodes of an arbitrary picture element it is turned on; and data signal generating means for generating data signals in parallel bit format, equal in number to the number of first electrodes comprising the successively selected groups of first electrodes and corresponding to a pattern to be visually displayed and for applying the bits of successive ones of said data signals to said means as successive control signals for enabling picture elements defined by said selected group of first electrodes and said second electrodes to visually display the pattern represented by said data signals.

3. A display and driving circuit according to claim 2, wherein said selection circuit means is effective to generate a third voltage selection signal having a constant voltage value of $|V_O|$, a first voltage selection signal comprising voltage pulses having a value of $2|V_O|$ and a duty factor of one to two, and a second voltage selection signal comprising voltage pulses having a value of $2|V_O|$, a duty factor of one to two and a phase difference from the first selection voltage signal; and wherein said means is effective for generating first, second, third and fourth voltage signals have the same waveforms having voltage value of $|V_O|$ and $2|V_O|$ and different phases relative to one another.

* * * * *